United States Patent [19]

Case et al.

[11] Patent Number: 4,898,548

[45] Date of Patent: Feb. 6, 1990

[54] CONNECTOR ASSEMBLY

[75] Inventors: Arnold A. Case, West Chicago; Robert DeRoss, Naperville, both of Ill.

[73] Assignee: Molex Incorporated

[21] Appl. No.: 65,675

[22] Filed: Jun. 17, 1987

Related U.S. Application Data

[63] Continuation of Ser. No. 778,476, Sep. 20, 1985.

[51] Int. Cl.[4] ..... H01R 13/00

[52] U.S. Cl. ..... 439/686

[58] Field of Search ..... 439/733, 732, 741, 752, 439/751, 744, 745, 870, 871, 873, 707, 686

[56] References Cited

U.S. PATENT DOCUMENTS

| | | | |
|---|---|---|---|
| 2,255,763 | 9/1941 | Doughman | 339/207 R |
| 4,045,110 | 8/1977 | Sterken | 339/210 M |
| 4,200,350 | 4/1980 | Zimmerman | 339/210 M |

*Primary Examiner*—Joseph H. McGlynn

*Attorney, Agent, or Firm*—Louis A. Hecht; Stephen Z. Weiss

[57] ABSTRACT

Disclosed is an improved connector assembly including a terminated wire, a crimp-type terminal, and a two-piece housing assembly of interfitting carrier and cover members. The terminal is crimped to the wire in a conventional fashion, presenting a portion of reduced cross section at the crimp engagement with the wire. The terminated wire is loaded into channels formed in a carrier member. The carrier member includes protrusions received in the reduced cross section of the crimp portion. After mounting of the terminals, the carrier is telescopically inserted in a sleeve-like cover member. An excessive crimp height prevents the complete reception of the terminal within the carrier channel, thereby preventing telescopic insertion of the carrier within the cover member. Thus, an excessive crimp height in the crimp portion of the terminal is visually indicated during connector assembly. In a similar fashion, a rotational misalignment of the terminal with respect to the carrier will also prevent insertion of the carrier within the housing. Improved terminal retention against pull-out and push-out forces is provided by the projection, upon insertion in the reduced cross sectional crimp portion of the terminal.

2 Claims, 2 Drawing Sheets

CONNECTOR ASSEMBLY

This application is a continuation of application Ser. No. 778,476 filed Sept. 20, 1985.

BACKGROUND OF THE INVENTION

1. Field of the Invention

The present invention relates to two-piece multi-lead connectors including a housing and terminal insert. More particularly, it relates to a new and improved two-piece connector with a terminal mounting means on the insert which permits only properly crimped terminals installed in the proper orientation on the insert to be successfully inserted into the connector housing.

2. Description of the Prior Art

Two-piece connectors for terminated wire leads, generally comprising a connector housing and a telescopically received terminal insert or carrier having terminated wire leads maintained thereon are known. Two-piece assemblies are desirable because of their ease of assembly and modularity. When the connector must accommodate and manage a plurality of terminated leads, special considerations arise. Each terminated lead, for example, in a pin and socket mating arrangement, has an associated force that is required to mate the terminal with another corresponding component, i.e. in both insertion and withdrawal directions. When a connector contains several leads, the cumulative insertion and withdrawal forces associated with mating the connector to another component can be very high. In these multi-lead two-part connectors, the terminal insert member must be reliably retained in the connector housing during mating and unmating of the connector, to prevent the connector from coming apart in use.

For some applications, for example in contaminated environments, high mating forces for each terminal are desireable or required. More particularly, high mating forces for a given terminal can ensure a sufficient wiping action between the terminal and mated contact to remove oxide coatings or other contaminants from the contact surfaces during mating to provide a gas-tight seal necessary for a reliable electrical connection. In these applications the terminated leads must be reliably retained in the terminal insert so that terminal push-out or pull-out does not occur during coupling or uncoupling of the connector.

Terminal retention is also important in other rugged environments where it is forseeable that the connector will be unmated by an operator pulling on the wires rather than the connector housing, or tripping over them, or the like. In automotive applications, terminal retention is required despite unforeseen circumstances or environmental conditions.

Generally in rugged environments, crimp-type terminals are preferred because the mechanical gripping connection between the metal terminals and wire leads in the crimp section, is generally stronger than found with other types of terminal to wire connections, for example, in insulation displacement type terminals. Nevertheless, engagement with a conductive wire in a crimp-type terminal is satisfactory only for a given, rather narrow range of terminal compression about the wire. If the wire engaging crimp portion is insufficiently compressed, the necessary low resistance electrical connection between terminal and wire will not be realized. A ready visual indication of improper height of the crimp portion, i.e., a defective crimp termination is desired so that defective wire leads are detected before the connector is fully assembled.

Further, some connector arrangement has terminals with mating portions located off center from the axis of the remaining terminal body. Other terminals have asymmetric cross sectional configuration, such as blade or flag-type terminals. For these arrangments, the relative angular orientation of the terminal with respect to its dielectric housing is crucial for successful connector operation. A ready visual indication of angular terminal orientation is desired.

SUMMARY OF THE INVENTION

Accordingly, it is an object of the present invention to provide an electrical connector assembly having an improved terminal retention arrangement, which provides ready verification of crimp quality and provides a mounting arrangement to ensure that each terminal is mounted on the insert in proper orientation for mating, prior to final assembly.

This object is provided in an electrical connector assembly including a housing having a forward mating end with an opening and an opposed conductor receiving end with an opening having an insert receiving cavity extending therebetween, an insert telescopically received in said cavity, said insert including at least one channel adapted to receive a terminated wire lead, said channel cooperating with said housing to define a terminal receiving passageway, a terminal received within said passageway including a forward mating end and a rear end, a conductor crimped in said rear end to form a terminated wire lead; means for retaining the terminated lead in the channel; and means for releaseably locking said insert within the housing, the improvement comprising:

terminal mounting means on said insert, said mounting means comprising an upstanding platform disposed intermediate the length of the channel having an upper surface adapted to support the rear end of the terminal within a constricted region defined between the upper surface of the platform and the interior of the cavity, the cross section of said constricted region being slightly larger than the cross section of a properly crimped terminal and smaller than the cross section of an improperly crimped terminal, whereby only a properly crimped terminated lead is receivable into the passageway.

Still another object of the present invention is to provide a ready visual indication of angular terminal orientation with respect to the housing to which it is mounted. This object is provided in an assembly of the type described above wherein the the periphery of the constricted region is adapted to closely-receive the periphery of the rear end of the terminal in one orientation only, whereby only a properly oriented crimped terminated lead is receivable into the passageway.

BRIEF DESCRIPTION OF THE DRAWINGS

In the drawings, wherein like elements are referenced alike.

DETAILED DESCRIPTION OF THE PREFERRED EMBODIMENT

Figure 1:
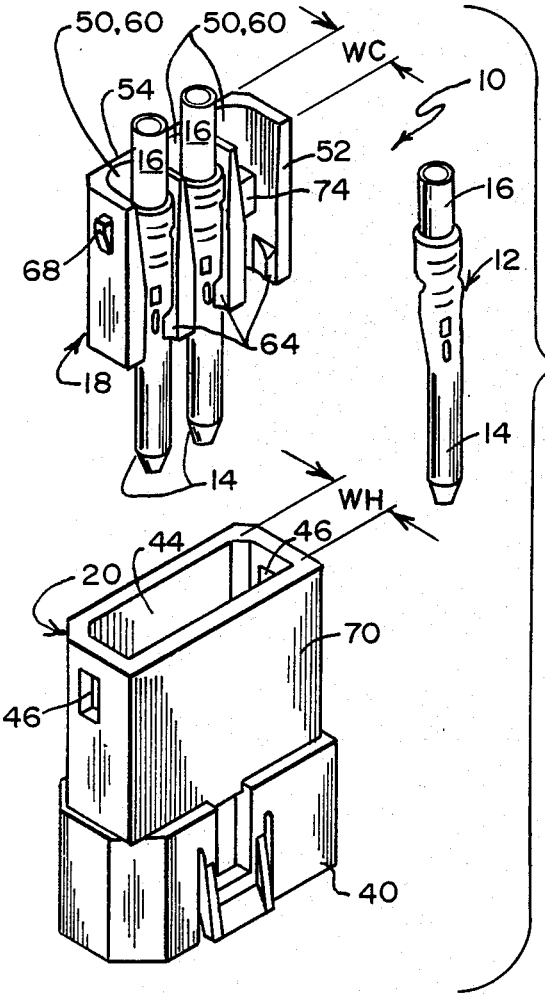
FIG. 1 is an exploded perspective view of the electrical connector assembly of the the present invention.

Turning now to FIG. 1, a connector assembly according to the present invention is indicated generally at 10. Assembly 10 includes a terminated wire lead 12 comprising a terminal 14 engaging an insulation clad wire 16. According to the present invention, terminal 14 has a crimp-type engaging portion and wire 16 has a leading bared end, suitable for a conventional crimp connection. These features will be described in greater detail herein.

Figure 2:
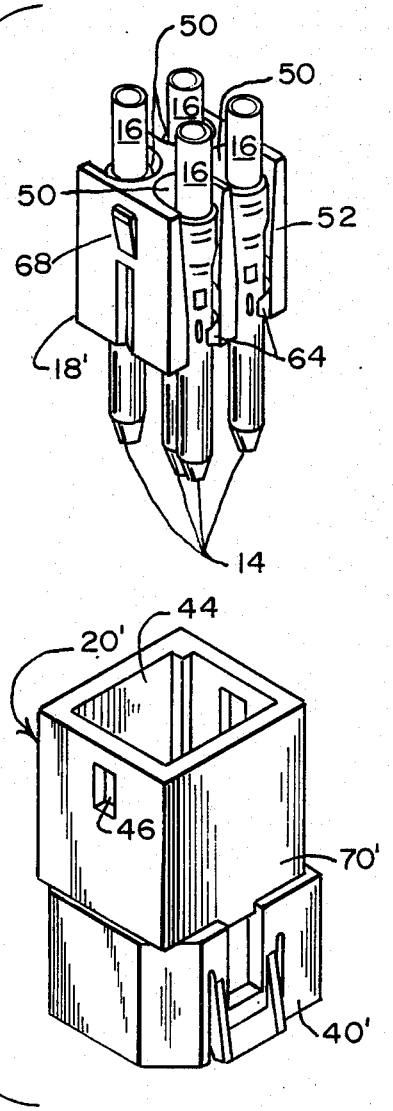
FIG. 2 is an exploded perspective view of an alternate embodiment of the connector assembly of the present invention.

The terminated wire subassembly 12 is mounted in a two-piece housing assembly comprising a carrier member 18 and a cover-like housing 20. The connector assembly shown in FIG. 1 comprises a single planar array of terminated wires, whereas the embodiment of FIG. 2 has a second planar array of wires arranged back to back with the arrangement of FIG. 1. The carrier member 18' of FIG. 2 is conveniently integrally molded to contain both planar arrays but in other features is identical to the arrangement of FIG. 1.

Figure 4:
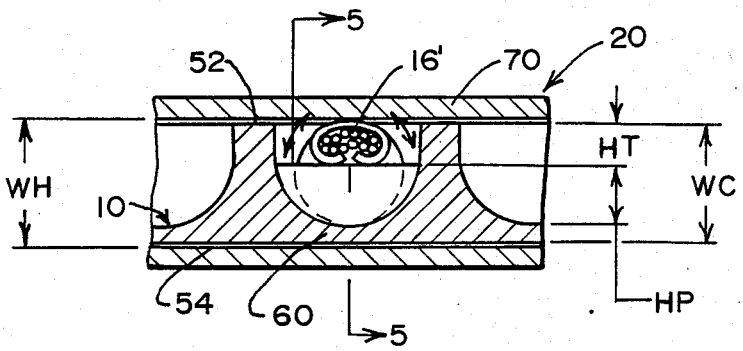
FIG. 4 is a partial cross sectional view of a completed electrical connector assembly according to the present invention.
Figure 5:
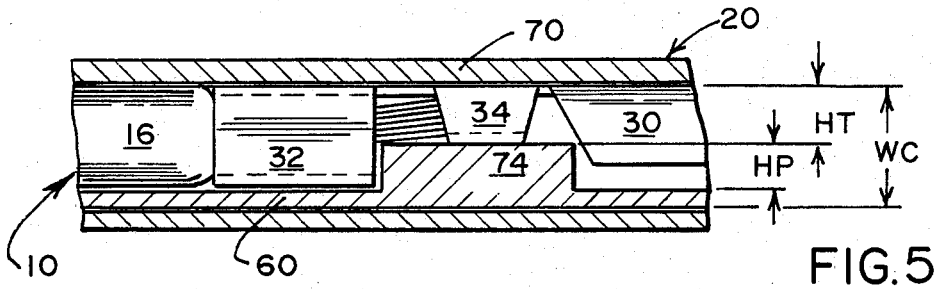
FIG. 5 is a longitudinal sectional view of the completed connector assembly of FIG. 4.

Referring now to FIGS. 4 and 5, the terminal 14 of terminated lead 12 comprises a forward mating part 30, a rear strain relief portion 32, and an intermediate crimp-type wire engaging portion 34. As shown most clearly in FIG. 5, mating part 30 has a cross-sectional height roughly equal to the sum of the vertical dimensions HT and HP, whereas wire engaging portion 34 has a reduced cross-sectional height equal to HT alone. The trailing strain relief portion 32 has a cross sectional height substantially greater than that of wire engaging portion 34. In practice, wire engaging portion 34 and strain relief portion 32 are simultaneously formed in a single die to comprise a crimp part of repeatable size and shape.

As is known in the art, wire engaging portion 34 is conveniently applied to a bared leading portion 16' of wire 16, and is inwardly deformed and compressed about that bared portion. As indicated in FIG. 4, wire engaging portion 34 when terminated to wire 16 has an elongated cross section, a feature which is relied upon to provide a ready visual indication of the terminal's angular orientation. As is appreciated by those skilled in the art, the amount of inward deformation or compression of wire engaging portion 34 about wire 16 is crucial to the proper electrical connection between the terminal and wire. Typically, the wire-engaging portion is formed by placing terminal 14 on an anvil-like die, inserting the barred leading end 16' of wire 16, and lowering an opposed crimping die so as to deform wire-engaging portion 34, compressing it so as to establish mechanical and electrical engagement with the conductor portion of wire 16. One problem that may affect connector performance, is the inadequate compression of the wire-engaging crimp portion by the mating die members. Inadequate compression of the wire-engaging crimp portion would result in a "crimp height" HT greater than the desired amount. The connector assembly of the present invention provides a ready visual indication of such improperly enlarged crimp height.

Referring now to the interengagement of the two dielectric members 18, 20, the terminated wire leads 12 are mounted to carrier portion 18, which is then inserted in the cover-like housing 20. Housing 20 has a mating end 40, and opposed open carrier receiving end 42, and a carrier receiving cavity 44 extending between those ends. In a preferred embodiment, carrier receiving cavity 44 has a constant cross-sectional dimension throughout the length of housing 20, although this is not required in all embodiments made according to the present invention. Of critical importance, however, is the interior dimension of open housing end 42, particularly the width WH thereof. Housing 20 is conveniently provided with a pair of opposed locking windows 46 to maintain the engagement between carrier 18 and housing 20.

Figure 3:
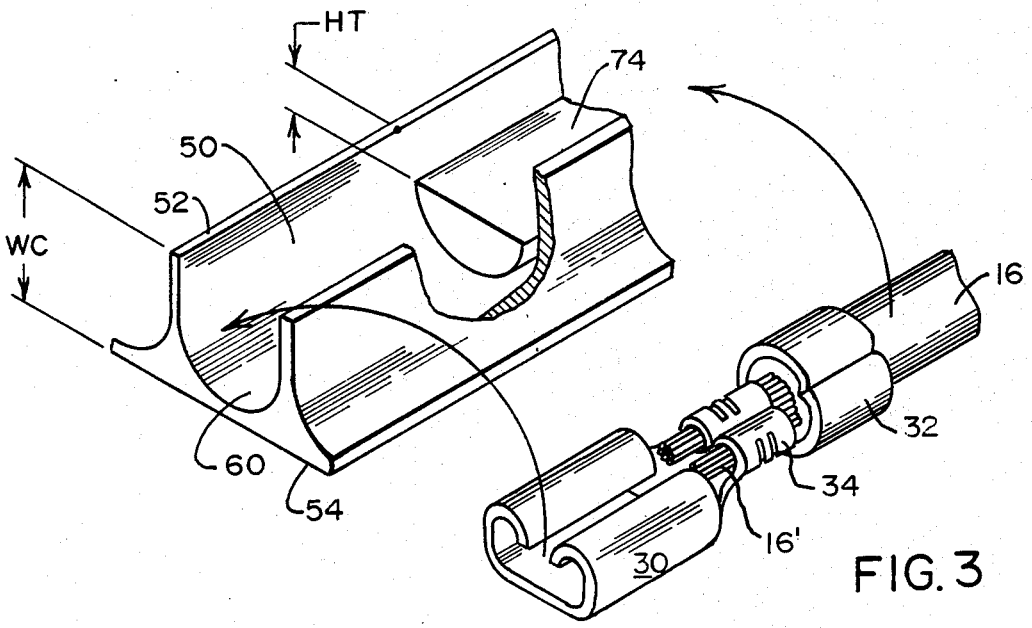
FIG. 3 is a partial perspective view of the carrier and terminated wire assembly shown just prior to assembly.

Carrier 18 includes a plurality of terminal receiving channels 50 having a depth d (see FIG. 3) extending between opposed outside surfaces 52, 54. Channels 50 have an open side 58 which open to surface 52, allow transverse loading of terminated wire leads 12. As will be seen in the figures, the depth of channel 50 is less than the overall width of the carrier WC only by an amount equal to the thickness of the bottom channel wall 60 which opposes the open side 58.

As indicated in FIG. 1, terminated wire leads 12 are loaded in a transverse direction into terminal receiving channels 50, and are temporarily held therein during connector assembly by resilient finger portions 64. Carrier 18 is thereafter telescopically inserted in the open end 42 of housing 20. Outwardly projecting locking portions 68, formed adjacent the trailing end of carrier 18 are received in locking windows 46, to maintain the engagement between dielectric members 18, 20.

The width of carrier 18, designated WC in FIG. 1, is closely held to the internal width WH of housing 20 to provide a close tolerance interfitting relationship. Any protrusion of terminal 14 beyond carrier surface 52, will interfere with the side wall 70 of housing 20 preventing a complete insertion of carrier 18 within the housing.

Visible in each of the figures, is a terminal engaging member or platform 74 projecting a predetermined cross-sectional height HP into channel 50. As indicated in FIGS. 4 and 5, the height HP of engaging member 74 is chosen such that when added to the thickness of bottom wall 60, and the height HT of wire-engaging portion 34, the combined total of these heights equals the width WC of carrier 18. Therefore, if the crimp height HT of wire-engaging portion 34 exceeds its specified value, the overall width of the installed terminal and carrier will exceed WC, preventing insertion of carrier 18 in housing 20. Thus, a ready visual indication of a proper crimp height is provided in connector assembly of the present invention.

Referring now to FIG. 4, the above-described features of terminal engaging member 74 are advantageously employed to provide a ready visual indication of the angular orientation of terminal 14 relative to carrier 18. As shown in FIG. 4, the cross section of wire-engaging portion 34 is elongated in an amount greater than HT, the maximum crimp height allowed by the complete carrier insertion in housing 20. As can be seen in FIG. 4, any angular displacement of wire-engaging portion 34 (and hence of mating portion 30) will result in a protrusion above carrier surface 52. Therefore, according to the angular orientation features of the present invention, the wire-engaging portion 34 is provided with a unique angular orientation at which the crimp height HT is a minimum. Expressed differently, the periphery of the constricted region defined between the upper surface of platform 74 and the interior of the cavity 44 is adapted to closely receive the periphery of a properly crimped crimp section 34 of terminated lead 12 in one orientation only, i.e., crimp-down, as shown in FIG. 4. Mating end 30 of the blade receiving terminal 14, shown in FIG. 3, therefore will also be presented seam or slit down and will extend within channel 50 parallel to bottom wall 60 of carrier 18. Any other rotational or angular orientation of crimp section 34, will present a crimp section height which exceeds HT, so that the terminal will not be receivable in the passageway defined between channel 50 and the interior of the housing cavity. At a 180 degree orientation, i.e., crimp up, the mating portion 30 will not be receivable in the passageway for the reason that a carrier with terminated leads mounted in this orientation would not fit into the housing. In this manner the connector of this invention utilizes the crimp section of the terminal to ensure proper orientation of the blade receiving mating end 30 of the connector for mating.

As indicated in FIG. 5, terminal engaging member 74 closely approximates the gap of reduced terminal width appearing between terminal portions 30, 32. Any axial displacement of terminated lead 12 (in the direction of arrow 90) will cause an interference with engaging member 74. Compared to other terminal retention arrangements employed to data, such as locking lances struck out from a terminal wall, the arrangement of the present invention offers greatly enhanced retention capability. Terminal retention is ensured in the direction of terminal push-out, as well as terminal pull-out, the terminal being held captive in its engagement with member 74 by the closely fitting housing member 20.

We claim:

1. In a connector arrangement including a housing having a forward mating end with an opening and an opposed conductor receiving end with an opening having an insert receiving cavity extending therebetween, an insert telescopically received in said cavity, said insert including at least one channel adapted to receive a terminated wire lead, said channel cooperating with said housing to define a terminal-receiving passageway, a terminal received within said passageway including a forward mating end and a rear end, a conductor crimped in said rear end to form a terminated wire lead having a predetermined cross-sectional crimp height; mounting means for retaining said terminated lead in the channel; and means for releasably locking said insert within the housing;

the improvement comprising:

said insert including an upstanding projecting platform in said channel disposed intermediate the length of the channel having an upper surface adapted to support the rear end of the terminal, said platform cooperating with said housing to define a constricted region between the upper surface of the platform and the interior of the cavity, the cross section of said constricted region defining a maximum crimp height whereby only those terminated leads having a crimp height less than said maximum crimp height are receivable into the passageway.

2. A connector as defined in claim 1, wherein said platform further cooperates with the housing to define a cross-sectional configuration in said contricted region adapted to closely receive the rear end of the terminal in a single crimp-down orientation only, whereby only a crimp terminated lead oriented with the rear portion of the terminal crimp-down on the platform is receivable into the passageway.

* * * * *